US006050342A

United States Patent [19]

Ramsey

[11] Patent Number: 6,050,342

[45] Date of Patent: Apr. 18, 2000

[54] APPARATUS AND METHOD FOR SETTING A COMPRESSION SET PACKER

[75] Inventor: Robert Michael Ramsey, Missouri City, Tex.

[73] Assignee: Scheumberger Technology Corporation, Sugar Land, Tex.

[21] Appl. No.: 09/074,194

[22] Filed: May 7, 1998

[51] Int. Cl.[7] ..... E21B 33/12

[52] U.S. Cl. ..... 166/387; 166/194; 166/196; 166/135; 166/181

[58] Field of Search ..... 166/387, 135, 166/181, 191, 194, 196

[56] References Cited

U.S. PATENT DOCUMENTS

| | | | |
|---|---|---|---|
| 3,603,390 | 9/1971 | McGill | 166/196 |
| 5,058,673 | 10/1991 | Muller et al. | 166/191 X |
| 5,540,280 | 7/1996 | Schultz et al. | 166/250.07 |

*Primary Examiner*—Roger Schoeppel
*Attorney, Agent, or Firm*—Jeffrey E. Griffin; Jamie A. Castano; John J. Ryberg

[57] ABSTRACT

Disclosed herein is a method and apparatus for setting a compression seal pack in a well without rotation of the pipe string and setting mandrel. The setting device includes a release device and a moveable member. The release device secures a setting mandrel in a non-engaged position with respect to the seal packer. The moveable member is positionable to a first position, where the setting mandrel is locked in its non-engaged position, and to a second position, where the release device is free and the setting mandrel may move with respect to the seal packer. The method disclosed herein includes coupling the setting device to a compression set packer, positioning a setting mandrel within the seal packer and setting device, positioning the seal packer at the desired location in a well, releasing the setting mandrel from its non-engaged position with respect to the seal packer and lowering the setting mandrel into engagement with said packer to set the packer in the well.

32 Claims, 4 Drawing Sheets

APPARATUS AND METHOD FOR SETTING A COMPRESSION SET PACKER

BACKGROUND OF THE INVENTION

1. Field of the Invention

The present invention is generally directed to the drilling of oil and gas wells, and, more particularly, to the setting of a compression set packer in such wells.

2. Description of the Related Art

The use of a compression set packer within a well to isolate various regions of a formation for selective production is well known in the industry. Traditionally, the setting of a compression set packer within a well has required the manipulation of a pipe string to which the compression set packer is attached.

The setting of a compression set packer using the aforementioned pipe string manipulation method requires the generation of approximately one-quarter turn of the pipe string at the location of the compression set packer within the well. Depending on the depth of the well and the configuration of the well, this requirement for a quarter-turn of the pipe string at the compression set packer may require approximately four to five turns of the pipe string at the well platform. The problem is even greater with respect to deviated wells, wherein the number of turns required at the platform to generate a one-quarter turn at the compression set packer may be greater.

Additionally, as is well known to those skilled in the art, in the drilling of sub sea wells, a plurality of control lines, typically hydraulic lines, are run from the sub sea well head located at the ocean floor to the offshore drilling platform. These lines are typically coupled to the drill pipe as a compression set packer is lowered into the well for setting at the appropriate location. However, given the presence of these hydraulic lines, the rotation of the pipe string is undesirable during the traditional technique of setting the compression set packer in that it may lead to tangling of the lines or damage to the lines.

The present invention is directed to a method and apparatus that solves or reduces some or all of the aforementioned problems.

SUMMARY OF THE INVENTION

The present invention is directed to a device for setting a compression set packer. The device is comprised of a housing, a moveable member positioned adjacent said housing, and a release device. The release device is adapted for engagement with at least the housing and the moveable member. The moveable member is positionable to a first position where a setting mandrel is maintained in a non-engaged position with respect to the compression set packer, and to a second position where the release device is free and the setting mandrel is free to move with respect to the compression set packer.

The present invention is also directed to a method for setting a compression set packer in a well. The method comprises coupling a setting device to a portion of the packer, positioning a setting mandrel within the packer and the setting device, and securing the setting mandrel into a non-engaged position with respect to the compression set packer. The method further comprises positioning the compression set packer at a desired location in the well, releasing the setting mandrel so that it is free to travel with respect to the compression set packer, and setting the compression set packer by lowering the setting mandrel into engagement with the compression set packer.

BRIEF DESCRIPTION OF THE DRAWINGS

The invention may be understood by reference to the following description taken in conjunction with the accompanying drawings, in which like reference numerals identify like elements, and in which.

Figure 1:
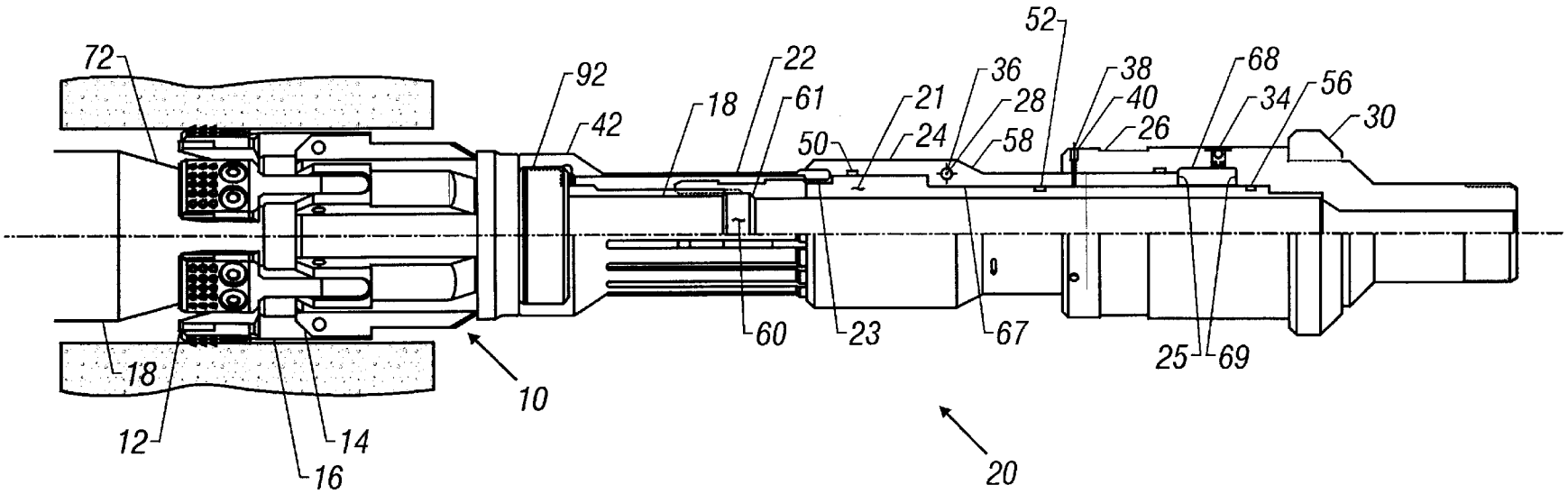
FIG. 1 is a partial cross-sectional view of a compression set packer and a setting device with a setting mandrel in a non-engaged position with respect to the compression set packer.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
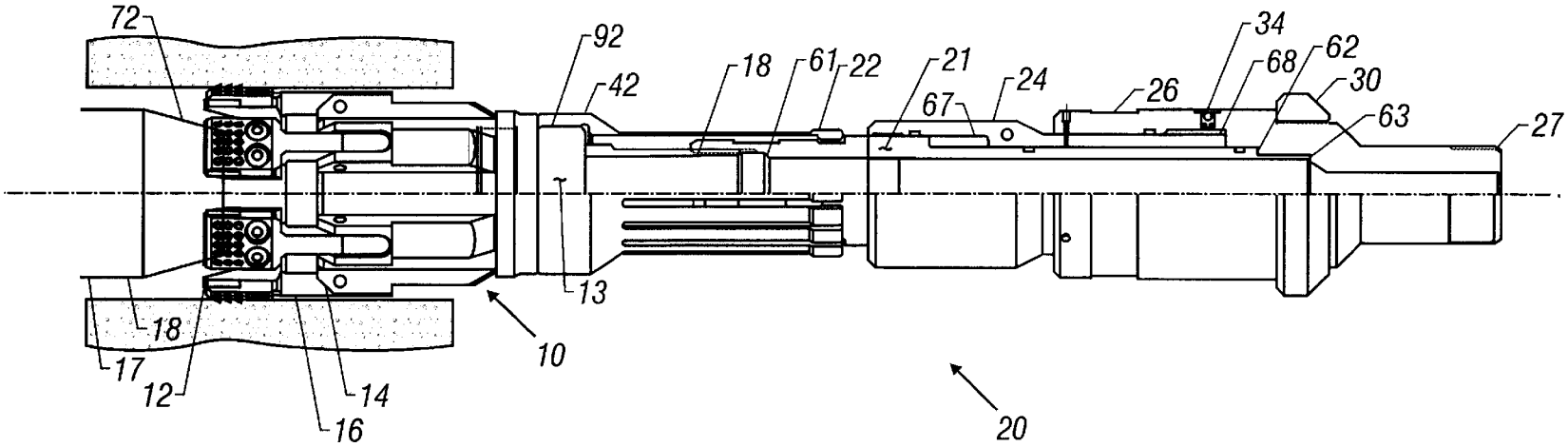
FIG. 2 is a partial cross-sectional view of the apparatus of FIG. 1 showing a moveable member of the setting device in a position whereby the setting mandrel is free to travel with respect to the compression set packer.
Figure 3:
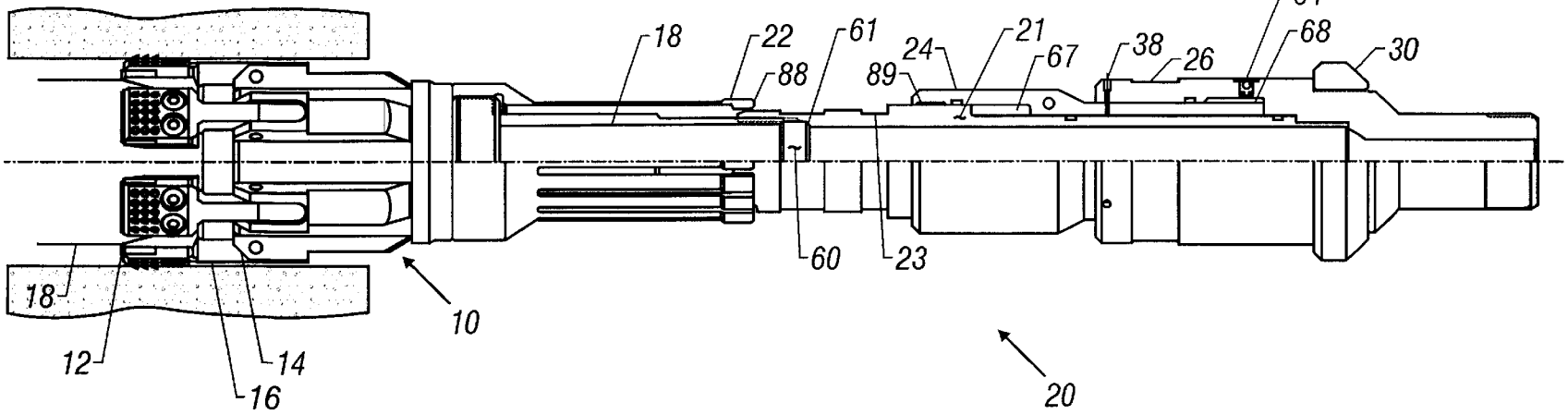
FIG. 3 is a view of the compression set packer engaged with the setting mandrel and set in the well.

As shown in FIGS. 1–3, a compression set packer 10 may be releasably coupled to a packer setting device 20. The compression set packer 10 is generally comprised of a plurality of slips 12, a plurality of friction pads 14 positioned within a friction pad housing 16, and a packer setting mandrel 18. The configuration of the compression set packer 10 is illustrative only and does not constitute a limitation of the present invention. Those of skill in the art will readily recognize that there are a variety of commercially available compression set packers that are suitable for use with the present invention.

In one embodiment, the setting device 20 may be comprised of a housing 21, a plurality of collet fingers 22, a moveable member 24, a bottom sub 26, and an actuating device 28. The setting device 20 may further include a gauge ring 30, a plurality of seals 50, 52, 54, 56, a retention device 38, and a test opening 34. In one embodiment, the actuating device 28 is a rupture disk 36 and the retention device 38 is a plurality of shear pins 40. The setting device 20 is adapted to be releasably coupled to the lower end 13 of the friction pad housing 16, which is part of the compression set packer 10. In one embodiment, the setting device 20 is releasably coupled to the lower end 13 of the compression set packer 10 by a threaded connection 42.

As is readily apparent to those skilled in the art, the various configurations of the components of the setting device 20 shown in the drawings are illustrative only and do not constitute a limitation of the present invention. For example, the housing 21 is depicted in the drawings as a sleeve through which the setting mandrel 18, as well as other pipe, may pass. Those skilled in the art recognize that the housing 21 could be configured in any number of ways and still accomplish the purposes of the present invention. Similarly, the moveable member 24 is depicted in the drawings as a piston type device. Again, those skilled in the art will recognize that the moveable member 24 could be configured in a variety of shapes and still accomplish the purposes of the invention.

The components of the setting device 20 may be manufactured from a variety of materials depending upon the particular environment in which the device will be used. For example, the setting device 20 and all of its associated metallic components may be made from carbon or stainless steel. Similarly, the seals 50, 52, 54 and 56 may be made from any material that is suitable for the particular design conditions under consideration. In one embodiment, the seals 50, 52, 54 and 56 are O-rings that may be made of viton.

The operation of the setting device 20 will now be explained with reference to FIGS. 1–3. Initially, the setting device 20 is assembled and attached to the compression set packer 10 on the well platform prior to attaching the completed compression set packer 10 and setting device 20 assembly to a pipe string (not shown) for lowering to the sea floor. For example, an upper portion 17 of the packer setting mandrel 18 and a lower portion 27 of the bottom sub 26 may be attached to a pipe string (not shown) by threaded connections.

As shown in FIG. 1, the housing 21 is positioned within the bottom sub 26 and rests on shoulders 62 and 63 formed on an interior surface of the bottom sub 26. The packer setting mandrel 18 has a rib 60 that is engaged with a shoulder 61 formed on the housing 21. As shown in FIG. 1, the collet fingers 22 are in their engaged position. The collet fingers 22 are retained in this engaged position by their engagement with the moveable member 24. In their engaged position, the collet fingers 22 are also engaged with a recess 23 formed in the housing 21. The collet fingers 22 may be attached to the compression set packer 10 by, for example, a threaded connection 42, to collet finger housing 92.

The moveable member 24 is retained in the position shown in FIG. 1 by the retention device 38. The purpose of the retention device 38 is to prevent unanticipated downward movement of the moveable member 24 after the setting device 20 is assembled and as the combined compression set packer 10 and setting device 20 assembly is in the process of being lowered to the sea floor. As those skilled in the art will recognize, this purpose can be accomplished by numerous techniques. In one embodiment, the retention device 38 is comprised of a plurality of shear pins 40.

A gauge ring 30 may be attached to the bottom sub 26 to insure that the moveable member 24 does not engage the inner surface of the well casing (not shown) as the compression set packer 10 and setting device 20 assembly is lowered downhole. The gauge ring 30 acts to insure that the moveable member 24 is free to move at the appropriate time.

As shown in FIG. 1, when assembled, the setting device 20 defines two pressure chambers 67 and 68. The pressure chamber 67 is defined by the moveable member 24, housing 21, and seals 50 and 52. The pressure chamber 68 is defined by the bottom sub 26, moveable member 24, housing 21 and seals 52, 54 and 56. During assembly, the pressure chambers 67 and 68 are tested to insure their integrity. With the moveable member 24 in the position shown in FIG. 1, but prior to the attachment of the rupture disk 36 to the moveable member 24, the pressure chamber 67 is tested to insure its integrity. Thereafter, the rupture disk 36 is attached to the moveable member 24. The pressure chamber 68 is next pressure tested through the test opening 34.

The actuating device 28 is, when actuated, adapted to allow the moveable member 24 to move relative to the housing 21 and the bottom sub 26. In one embodiment, the actuating device 28 is a rupture disk 36 that is designed to rupture at a specific pressure that is determined by design considerations. As is readily apparent to those skilled in the art, the use of the rupture disk 36 as the actuating device 28 is illustrative only and the same function may be provided by a variety of different techniques.

After being configured as shown in FIG. 1, the compression set packer 10 and setting device 20 assembly is lowered in the well. During this process, the moveable member 24 is initially retained in the position shown in FIG. 1 by the plurality of shear pins 40. In this position, the packer setting mandrel 18 is prevented from moving downward due to the engagement of the rib 60 with the shoulder 61 formed in the housing 21 and the engagement of the collet fingers 22 with the recess 23 in the housing 21. The collet fingers 22 are maintained in engagement with the recess 23 by the moveable member 24. During this process, the setting mandrel 18 is not engaged with the compression set packer 10, and, thus, the compression set packer 10 is not set. Moreover, in the position shown in FIG. 1, the compression set packer 10 cannot be set because downward movement of the packer setting mandrel 18 is prevented. As shown in FIG. 1, the slips 12 are in their retracted position and they do not engage the casing (not shown) of the well as the compression set packer 10 and setting device 20 assembly is lowered into the well. During the lowering of this assembly, the spring-loaded friction pads 14 engage the inner surface of the well casing.

As is readily apparent to those skilled in the art, the pressure inside the well may be very high, for example, 10,000 pounds per square inch (psi). The pressure chambers 67 and 68, having been assembled and sealed at the surface, are at a pressure of approximately 14.7 psi. The moveable member 24 is designed such that the pressure in the well acts to keep the moveable member 24 in the position shown in FIG. 1. In one embodiment, this is accomplished by providing sufficient area on the sloped surface 58 such that, with a pressure of approximately 14.7 psi in the pressure chamber 67, the well pressure acting on the sloped surface 58 will maintain the moveable member 24 in the position shown in FIG. 1.

In one embodiment, rupturing the rupture disk 36 causes an increase in the pressure in the pressure chamber 67 from approximately 14.7 psi to the well pressure, for example, 10,000 psi. The moveable member 24 is designed such that, when the pressure chamber 67 is at well bore pressure, the moveable member 24 suddenly moves to the position shown in FIG. 2. The increase of the pressure in the pressure chamber 67 provides sufficient force to allow the moveable member 24 to shear the shear pins 40.

The moveable member 24 is driven from a first position shown in FIG. 1, where the setting mandrel 18 is not engaged with the compression set packer 10, to a second position, as shown in FIG. 2, where the collet fingers 22 are released and the setting mandrel 18 is free to travel with respect to the compression set packer 10. Further downward movement of the setting mandrel 18 will result in the setting of the compression set packer 10, as discussed more fully below. As stated above, in one embodiment, the actuating device 28 is a rupture disk 36 that may be designed for a particular application. For example, if it is desired that the compression set packer 10 be set at a depth in the well at which the hydrostatic pressure is 9800 psi, then a rupture disk 36 designed to rupture at a higher pressure, e.g, 10,000 psi, would be used. Thus, with the compression set packer 10 positioned at the appropriate level at which the hydrostatic pressure in the well is 9800 psi, the rupture disk 36 could be caused to rupture with an applied pressure of 200 psi. This applied pressure is typically generated by use of pumps at the surface.

As shown in FIGS. 2 and 3, after the collet fingers 22 are released, the setting mandrel 18 may be moved downward thereby causing the sloped surface 72 of the setting mandrel 18 to engage sloped surfaces (not shown) on the back of the slips 12. The engagement of these sloped surfaces forces the slips 12 into engagement with the inner surface of the casing or concrete in the well bore. Thereafter, further weight is applied to the pipe string to expand a plurality of packer elements (not shown) that are present on currently available compression set packers 10.

Figure 4A:
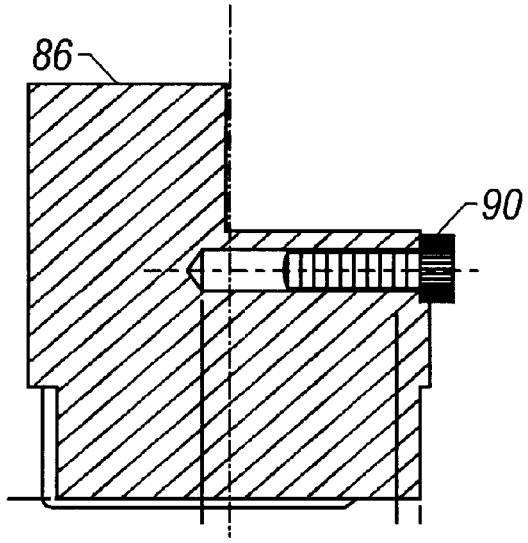
FIG. 4A is a side view of an indexing lug that may be used with the present invention.
Figure 4B:
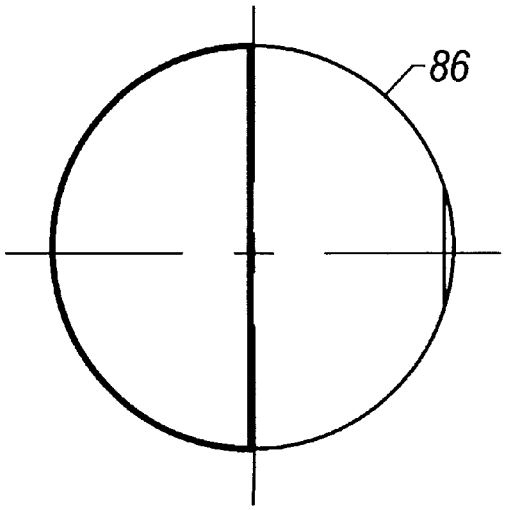
FIG. 4B is a top view of the indexing lug shown in FIG. 4A.

As shown in FIG. 1, the collet fingers 22 may be releasably attached to the friction pad housing 16 by, for example, the threaded connection 42 to collet finger housing 92. Using this technique, the lower end 13 of the friction pad housing 16 must have threads formed thereon. As is well known to those skilled in the art, typical compression set packers may be provided with an indexing lug that is positioned within a "J"-slot formed in the setting mandrel 18. One common way of retaining such an indexing lug in position relative to the friction pad housing 16 is through a bolted connection. However, during the formation of the threaded connection 42 on the lower end 13 of the friction pad housing 16, a portion of the standard indexing lug and collet are removed. Thus, as shown in FIGS. 4A–4B, a special indexing lug 86 is useful and is attached to the friction pad housing 16 (not shown) with a screw 90.

Alternatively, the collet fingers 22 may be releasably attached to the friction pad housing 16 by, for example, a plurality of screws spaced around the perimeter of the friction pad housing 16. Using this approach, the lower end 13 of the friction pad housing 16 must be turned down, i.e., have its diameter reduced, such that the collet finger housing 92 would slip over the reduced diameter. Thereafter, the collet finger housing 92 could be secured to the friction pad housing 16 with a plurality of screws spaced around the circumference, e.g., three screws spaced 120° apart.

The inventive method disclosed herein generally comprises releasably coupling a setting device 20 to a compression set packer 10, positioning a setting mandrel 18 with the compression set packer 10 and setting device 20, securing the setting mandrel 18 into a position in which it is not engaged with the slip 12 of the compression set packer 10, positioning the compression set packer 10 at the desired depth within a well, releasing the setting mandrel 18 from its non-engaged position so that it is free to travel with respect to the compression set packer 10, and setting the compression set packer 10 into position within the well by lowering the setting mandrel 18 into engagement with the compression set packer 10, whereby the slips 12 are forced outward and engage the well casing. As is readily apparent to those skilled in the art, through use of the present technique, the compression set packer 10 may be set without rotational movement of the pipe string.

It should be noted that, through use of the present inventive methods and device, the compression set packer 10 may be reset multiple times as the compression set packer 10 is withdrawn from the well. With reference to FIG. 3, upward movement of the setting mandrel 18 releases the slips 12 of the compression set packer 10. Continued upward movement of the setting mandrel 18 causes an end 88 of the collet fingers 22 to engage an end 89 of the moveable member 24. This engagement provides sufficient resistance such that continued further upward movement of the setting mandrel 18 results in upward movement of the compression set packer 10, which is, at this time, only held in place by friction pads 14.

When the compression set packer 10 reaches the next desired setting position within the well, upward movement of the packer setting mandrel 18 is stopped. At this time, the compression set packer 10 is maintained in its new desired position by the friction pads 14. As is readily apparent to those skilled in the art, downward movement of the packer setting mandrel 18 causes the inclined surface 72 of the packer setting mandrel 18 to once again engage the inclined surfaces on the back of the slips 12, thereby forcing the slips 12 into engagement with the well casing and setting the compression set packer 10 at the new location.

The present invention may also be combined with the known technique of setting a compression set packer 10 through use of rotational movement, whereby an indexing lug 86 that is coupled to the friction pad housing 16 is free to move within a slot (known in the industry as a "J"-slot), formed in the setting mandrel 18 as the setting mandrel 18 is rotated and raised. If, in addition to being coupled to a setting device 20 disclosed herein, a compression set packer 10 is provided with standard indexing lug 86 discussed above, the compression set packer 10 may be set multiple times at depths in the well that are lower than the initial setting depth of the compression set packer 10.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A device for setting a compression set packer in a well, said packer adapted for being set into position within the well by a setting mandrel, comprising:

a housing, said housing adapted for engagement with at least a portion of said setting mandrel;

a moveable member positioned adjacent said housing;

a release device, said release device adapted for engagement with at least said housing and said moveable member; and said moveable member positionable to a first position where said setting mandrel is secured in a non-engaged position with respect to said packer and a second position where said release device is free and said setting mandrel is free to move with respect to said packer.

2. The device of claim 1, wherein said release device is comprised of a plurality of collet fingers.

3. The device of claim 1, wherein said moveable member is a piston.

4. The device of claim 1, wherein said moveable member is positioned around said housing.

5. The device of claim 1, further comprising a bottom sub, said bottom sub adapted for engaging at least a portion of said housing.

6. The device of claim 1, further comprising an activation device for allowing said moveable member to be moved from said first position to said second position.

7. The device of claim 6, wherein said activation device is a rupture disk.

8. The device of claim 1, wherein said release device is releasably coupled to at least a portion of said packer.

9. The device of claim 1, wherein said moveable member is adapted for non-rotational movement with respect to said sleeve.

10. The device of claim 1, wherein said housing is a sleeve that is positioned around said setting mandrel.

11. A device for setting a compression set packer in a well, said packer adapted for being set into position with the well by a setting mandrel, comprising:

a sleeve, said sleeve adapted for engagement with at least a portion of said setting mandrel;

a moveable member positioned adjacent said sleeve;

a release device, said release device adapted for engagement with at least said sleeve and said moveable member;

said moveable member positionable to a first position where said setting mandrel is maintained in a non-engaged position with respect to said packer and to a second position where said release device is released and said setting mandrel is free to move with respect to said packer; and an actuating device that, when actuated, allows said moveable member to move from said first position to said second position.

12. The device of claim 11, wherein said release device is comprised of a plurality of collet fingers.

13. The device of claim 11, wherein said moveable member is a piston.

14. The device of claim 11, wherein said actuating device is a rupture disk.

15. The device of claim 11, wherein said release device is releasably coupled to at least a portion of said packer.

16. The device of claim 11, wherein said moveable member is adapted for non-rotational movement with respect to said sleeve.

17. A device for setting a compression set packer in a well, said packer adapted for being set into position within the well by a setting mandrel, comprising:

a sleeve, said sleeve adapted for engagement with at least a portion of said setting mandrel;

a moveable member positioned around said sleeve;

a plurality of collet fingers adapted for engagement with said sleeve and said moveable member;

said moveable member positionable to a first position where said setting mandrel is maintained in a non-engaged position with respect to said packer and a second position where said release device is released and said setting mandrel is free to move with respect to said packer; and a rupture disk that, when ruptured, allows said moveable member to move from said first position to said second position.

18. The device of claim 17, wherein the moveable member is a piston.

19. The device of claim 17, wherein said moveable member is adapted for non-rotational movement with respect to said sleeve.

20. The device of claim 17, further comprising a bottom sub, said bottom sub adapted for engaging at least a portion of said sleeve.

21. A method for setting a compression seal packer in a well, comprising:

coupling a setting device to a portion of said packer;

positioning a setting mandrel within said packer and said setting device;

securing said setting mandrel into a non-engaged position with respect to said packer;

positioning said packer at a desired location in the well;

releasing said setting mandrel from its non-engaged position so that it is free to travel with respect to said packer; and setting said packer by lowering said setting mandrel into setting engagement with said packer.

22. The method set forth in claim 21, wherein the setting of said packer is accomplished without rotation of the setting mandrel.

23. The method set forth in claim 21, wherein securing said setting mandrel into a non-engaged position with respect to said packer comprises positioning a release device to an engaged position which will maintain said setting mandrel in said non-engaged position.

24. The method set forth in claim 23, wherein securing said setting mandrel into a non-engaged position with respect to said packer further comprises positioning a moveable member of said setting device to a first position to secure said release device in said engaged position.

25. The method set forth in claim 21, wherein said releasing of said setting mandrel from its non-engaged position comprises positioning said moveable member of said setting device to a second position where said release device is free to move from its engaged position.

26. The method set forth in claim 21, wherein said coupling of a setting device to a portion of said packer comprises releasably coupling the setting device to the packer.

27. A method for setting a compression set packer seal pack in a well, comprising:

coupling a setting device to a portion of said packer;

positioning a setting mandrel within said packer and said setting device;

securing said setting mandrel into a non-engaged position with respect to said packer;

positioning a release device to an engaged position which will maintain said setting mandrel in said non-engaged position with respect to said packer;

positioning a moveable member of said setting device to a first position to secure said release device in said engaged position;

positioning said packer at the desired location in the well;

releasing said setting mandrel from its non-engaged position so that it is free to travel with respect to said packer; and setting said packer by lowering said setting mandrel into setting engagement with said packer.

28. The method of claim 27, wherein the setting of said packer is accomplished without rotation of the setting mandrel.

29. The method of claim 27, wherein said releasing of said setting mandrel from its non-engaged position comprises positioning said moveable member of said setting device to a second position where said release device is free to move from its engaged position.

30. The method of claim 27, wherein releasing of said mandrel setting mandrel from its non-engaged position with respect to said packer comprises actuating a device to cause said moveable member to move from said first position to said second position.

31. The method of claim 30, wherein actuating a release device comprises increasing the pressure in said well until a rupture disk ruptures.

32. The method of claim 27, wherein releasably coupling said setting device to a portion of said packer comprises threading said setting device onto said packer.

* * * * *